US006976883B2

(12) United States Patent
Andres et al.

(10) Patent No.: US 6,976,883 B2
(45) Date of Patent: Dec. 20, 2005

(54) ADAPTOR APPARATUS AND METHOD FOR INTERCHANGING SMOKE ALARMS

(75) Inventors: John Andres, Chapel Hill, NC (US); Kenneth J. Mott, Colorado Springs, CO (US)

(73) Assignee: Walter Kidde Portable Equipment, Inc., Mebane, NC (US)

( * ) Notice: Subject to any disclaimer, the term of this patent is extended or adjusted under 35 U.S.C. 154(b) by 0 days.

(21) Appl. No.: 10/850,171

(22) Filed: May 20, 2004

(65) Prior Publication Data

US 2005/0009405 A1 Jan. 13, 2005

Related U.S. Application Data

(60) Provisional application No. 60/472,164, filed on May 20, 2003.

(51) Int. Cl.[7] ..... H01R 25/00
(52) U.S. Cl. ..... 439/638; 439/652
(58) Field of Search ..... 439/638, 607, 439/320, 76.1, 502, 926, 652, 651; 340/628–630, 340/693.5, 693.9, 693.11, 544, 317; 248/318, 248/342, 343, 551

(56) References Cited

U.S. PATENT DOCUMENTS

| | | | | |
|---|---|---|---|---|
| 3,767,917 | A * | 10/1973 | Lampart et al. | 250/384 |
| 4,074,341 | A * | 2/1978 | Niederost et al. | 361/600 |
| 4,091,363 | A | 5/1978 | Siegel et al. | |
| 4,129,383 | A * | 12/1978 | Malinowski | 356/439 |
| 4,239,319 | A | 12/1980 | Gladd et al. | |
| 4,389,635 | A * | 6/1983 | Gallagher | 340/287 |
| 4,424,553 | A * | 1/1984 | Marsocci et al. | 361/825 |
| 4,538,877 | A | 9/1985 | Novis | |
| 4,812,827 | A * | 3/1989 | Scripps | 340/693.1 |
| 4,897,052 | A | 1/1990 | Priest et al. | |
| 5,064,389 | A | 11/1991 | Klein et al. | |
| 5,281,147 | A | 1/1994 | Hughes | |
| 5,295,845 | A | 3/1994 | Changxing | |
| 5,417,593 | A | 5/1995 | Suzuki et al. | |
| 5,518,416 | A | 5/1996 | Kantner et al. | |
| 5,563,766 | A * | 10/1996 | Long et al. | 361/600 |

(Continued)

FOREIGN PATENT DOCUMENTS

| | | |
|---|---|---|
| DE | 1 640 555 | 10/1970 |

(Continued)

OTHER PUBLICATIONS

"BRK Electronics® Smoke Alarm 120V AC, 60Hz. w/Silence Feature and 9V Battery Back-Up" box, ©BRK Brands Inc., Catalog 4120SB (2001) with "Installation of Adapter Plug," ®BRK Brands Inc. (2003), 3 pages.

*Primary Examiner*—Ross Gushi
*Assistant Examiner*—Phuongchi Nguyen
(74) *Attorney, Agent, or Firm*—Merchant & Gould P.C.

(57) ABSTRACT

An adapter configured for use between an alarm device and a wire harness. The adapter includes a housing having first and second sides, a circuit board positioned at least partially within the housing, and a first connection configuration associated with the first housing side that includes a plurality of conductive contacts electrically coupled to the circuit board and configured to engage a first device. The adapter also includes a second connection configuration associated with the second housing side and having a plurality of male connection pins electrically coupled to the circuit board and configured to engage a second device. The second connection configuration includes a different connection configuration than the first receiver thereby providing an adaptive connection function between the alarm device and the wire harness.

28 Claims, 13 Drawing Sheets

U.S. PATENT DOCUMENTS

| | | | | | |
|---|---|---|---|---|---|
| 5,578,996 | A | * | 11/1996 | Watson et al. | 340/628 |
| 5,808,556 | A | * | 9/1998 | Nelson et al. | 340/693.6 |
| 5,848,907 | A | | 12/1998 | Chen | |
| 5,855,064 | A | | 1/1999 | Chang | |
| 5,871,376 | A | | 2/1999 | Tsai et al. | |
| 5,899,773 | A | | 5/1999 | Cheng | |
| 5,906,513 | A | * | 5/1999 | Peterson et al. | 439/607 |
| 6,039,608 | A | | 3/2000 | Amero et al. | |
| 6,302,717 | B1 | | 10/2001 | Cheung | |
| 6,371,815 | B1 | | 4/2002 | Wetzel et al. | |
| 6,435,916 | B1 | | 8/2002 | Amberg et al. | |
| 6,461,192 | B1 | | 10/2002 | Kwoka | |
| 6,641,433 | B2 | | 11/2003 | Devine et al. | |
| 2005/0088311 | A1 | * | 4/2005 | Deluca et al. | 340/693.9 |
| 2005/0134468 | A1 | * | 6/2005 | Thomas et al. | 340/630 |

FOREIGN PATENT DOCUMENTS

| | | | |
|---|---|---|---|
| DE | 16 40 555 | B2 | 9/1975 |
| DE | 39 10 514 | A1 | 10/1990 |
| DE | G 92 07 496.0 | U1 | 11/1992 |
| DE | 39 10 514 | C2 | 7/1998 |
| DE | 202 07 462 | U1 | 10/2002 |
| FR | 642086 | | 10/1927 |
| FR | 1445657 | | 5/1965 |
| GB | 1 594 094 | | 7/1981 |
| GB | 2 337 640 | A | 11/1999 |
| JP | 7-94219 | | 4/1995 |
| JP | 2000-164306 | | 6/2000 |

* cited by examiner

ADAPTOR APPARATUS AND METHOD FOR INTERCHANGING SMOKE ALARMS

CROSS REFERENCE TO RELATED APPLICATIONS

This application is a non-provisional of application Ser. No. 60/472,164, filed May 20, 2003, which application is incorporated herein by reference.

BACKGROUND OF THE INVENTION

1. Field of the Invention

The present invention relates generally to smoke alarms and smoke alarm systems, and more particularly relates to adapters for smoke alarms, fire alarms, carbon monoxide alarms, and systems incorporating these and other types of alarms.

2. Related Art

Many smoke alarm manufacturers provide an entire smoke alarm system for residential and commercial applications. A smoke alarm system typically includes multiple smoke alarms hard wired together with an interconnect wiring network that provides power to the alarms and may also connect the smoke alarms to a common control center. By providing a system of this type, the manufacturer can provide their own unique connector designs for connecting various components of the system together, such as connecting the smoke alarms to the interconnect wire network. One advantage for a manufacture who has installed this type of unique design for a consumer is that the consumer will have to go back to the same manufacturer to get new or updated alarms and other system components that connect to the consumer's system. A consumer's only other option is to incur the risk or added expense of removing and replacing these manufacture specific connectors with that of another manufacture. This may leave the consumer at a disadvantage because they have little to no option of using smoke alarms or other system components made by other manufactures that may be available at lower costs or provide certain features that are advantageous for the consumer's application.

SUMMARY OF THE INVENTION

The present invention relates generally to smoke alarms and smoke alarm systems, and more particularly relates to adapters for smoke alarms, fire alarms, carbon monoxide (CO) alarms, and systems incorporating these and other types of alarms. One aspect of the invention relates to a smoke alarm system that includes an interconnect harness electrically connected to a wiring network, a smoke alarm, and an adapter. The adapter includes a first connector configuration for coupling the adapter to the smoke alarm, and a second connector configurations for coupling the adapter to the interconnect harness. The first and second connector configurations are different from each other thereby providing an adaptive connection function between differing connection configurations of the harness and the smoke alarm.

Another aspect of the invention relates to an adapter configured for use with an alarm device. The adapter includes a housing having first and second sides, a circuit board positioned at least partially within the housing, and a first connection configuration associated with the first housing side that includes a plurality of conductive contacts electrically coupled to the circuit board and configured to engage a first device. The adapter also includes a second connection configuration associated with the second housing side and having a plurality of male connection pins electrically coupled to the circuit board and configured to engage a second device. The second connection configuration includes a different connection configuration than the first receiver thereby providing an adaptive connection function between differing connection configurations.

A further aspect of the invention relates to a method of manufacturing an adapter for use between an alarm device and a harness device. The adapter includes a housing, a male connector pin, and a conductive contact and the method includes forming first and second connection configurations. The first connection configuration is formed in a first side of the housing and includes the male connector pin at least partially housed within the housing and exposed at the first housing side. The second connection configuration is formed in a second side of the housing and includes the conductive contact at least partially housed within the housing and a pin receiving aperture formed in the second housing side and providing access to the conductive contact. The first and second connection configurations are adapted for connection to either the alarm device or the harness device.

Another aspect of the invention relates to an adapter configured for use with an alarm device. The adapter includes a first connector configuration having a plurality of conductive contacts adapted for coupling to the alarm device, and a second connector configuration having a plurality of connector pins adapted for coupling to a wiring harness. The conductive contacts and the connector pins are electrically coupled to each other and the first and second connector configurations are different.

A still further aspect of the invention relates to a method of manufacturing an adapter for use between an alarm device and a harness device. The method includes providing a first connection configuration having a first housing member and a plurality of conductive contacts and being adapted for connection to an alarm device, providing a second connection configuration having a second housing member and a plurality of connector pins and being adapted for connection to the harness device, the second connection configuration being different from the first connection configuration, and coupling the plurality of conductive contacts to the plurality of connector pins.

The above summary of the present invention is not intended to describe each disclosed embodiment or every implementation of the present invention. Figures in the detailed description that follow more particularly exemplify embodiments of the invention. While certain embodiments will be illustrated and described, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention relates to alarms, such as smoke, fire and CO alarms, and alarm systems, and more particularly relates to adaptors for connecting an interconnect wire harness having a first connector configuration to an alarm having a second connector configuration. As referred to herein, an "alarm" or a "smoke alarm" generally relates to smoke, fire, CO, and other similar types of alarms or alarm systems. An adaptor according to the present invention may be especially useful for adapting a wire harness connector configuration used by a first manufacturer to a alarm connector configuration for a second manufacturer that is different from the first manufacturer connector configuration.

An adaptor of the present invention may include a housing with first and second sides, wherein each side includes a different connector configuration. Typically, the housing will include a substrate or connection board, such as a circuit board, to which conducting contacts, connector pins, or the like features are mounted for each of the connector configurations, and further includes leads or traces on the substrate that electrically connect the electrical contacts of the two separate connector configurations.

Typically, one connector configuration on a first side of the housing may be generally designated as a female "receiver" that is configured to receive a male "connector," such as a wire harness connector of an innerconnect wiring network or system. The connector configuration on the second side of the adaptor may typically be considered a male "connector" that is configured to engage a female "receiver," such as a female receiver associated with a smoke alarm. The female style receiver in a smoke alarm may be formed in a housing of the smoke alarm or integrated into a wire harness electrically connected to the electronic components of the smoke alarm.

Figure 1:
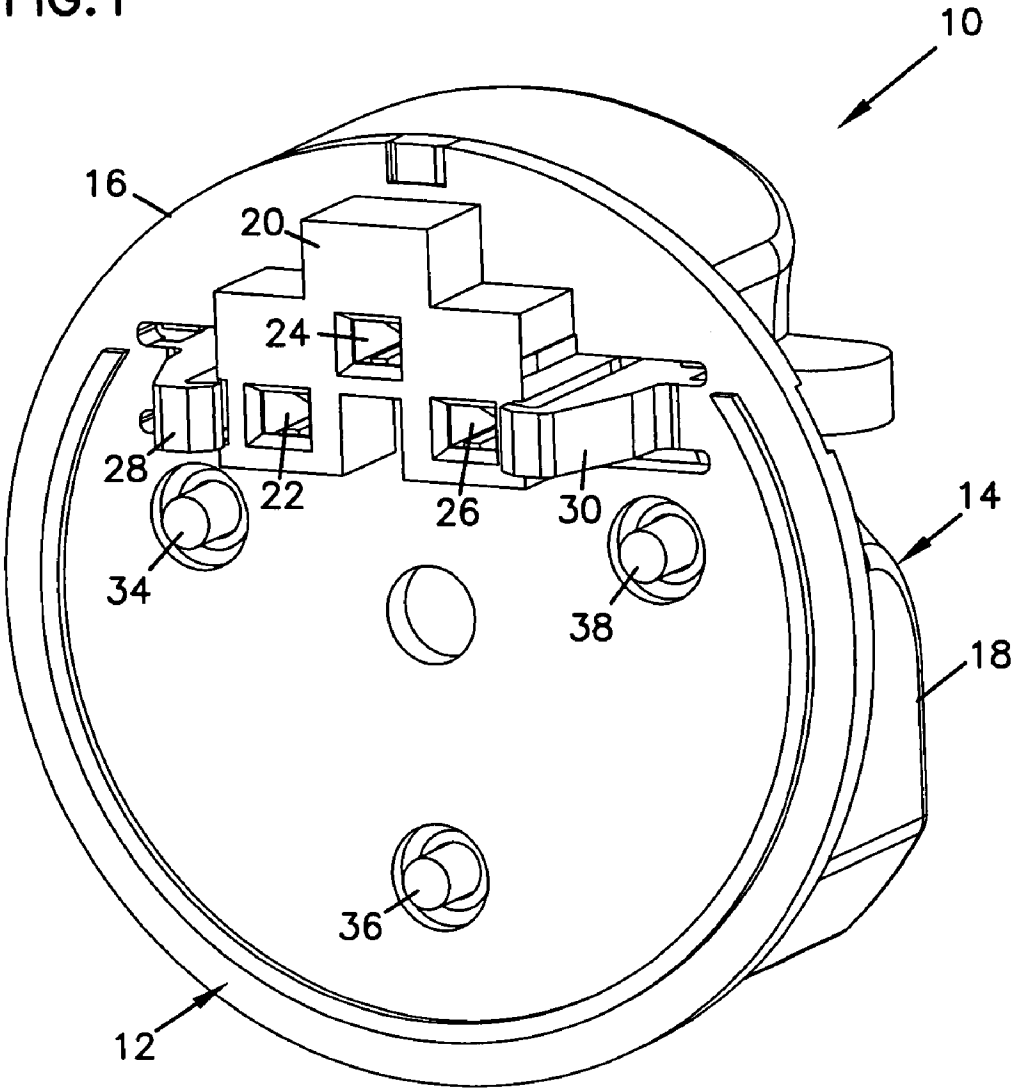
FIG. 1 is a perspective view of a first side of one example adaptor according to principles of the invention.
Figure 2:
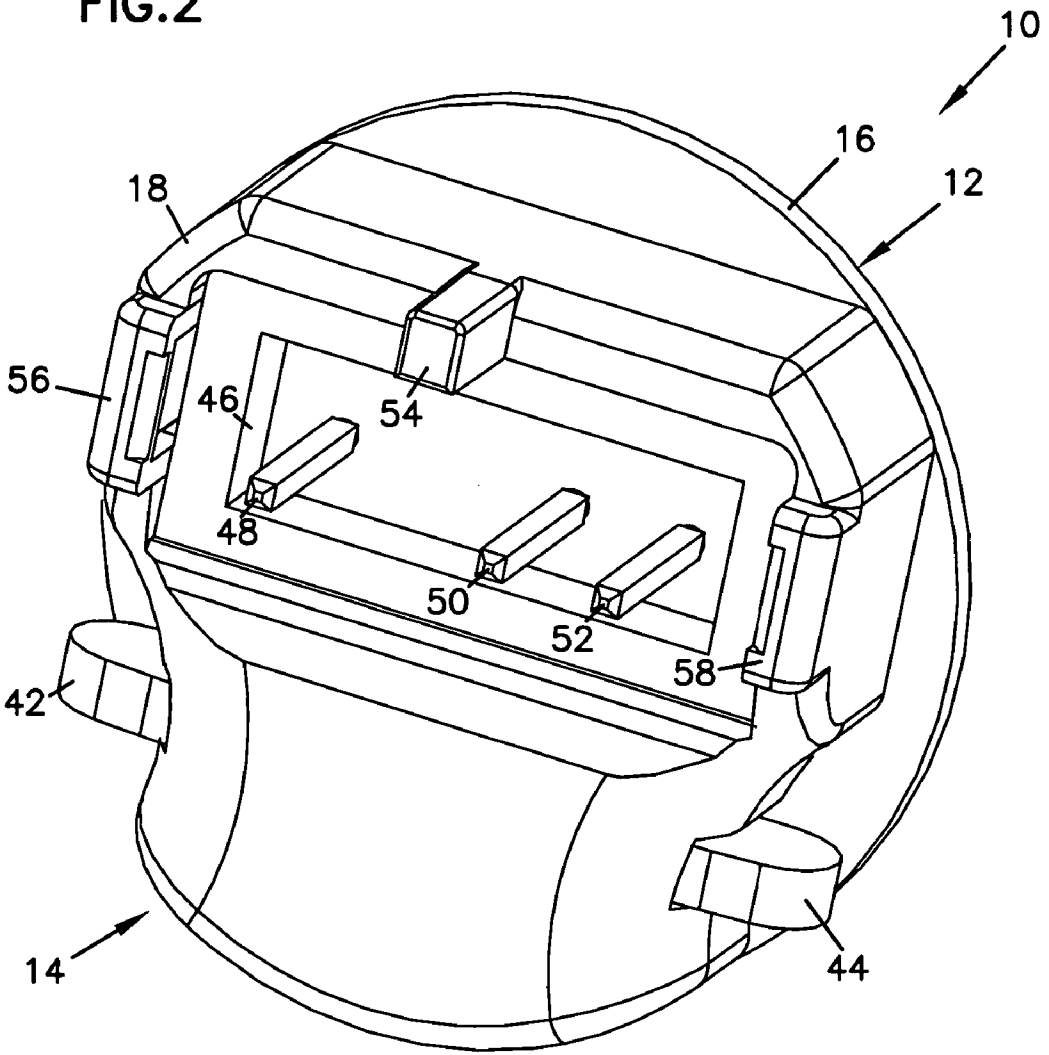
FIG. 2 is a perspective view of a second side of one example adaptor according to principles of the invention.
Figure 3:
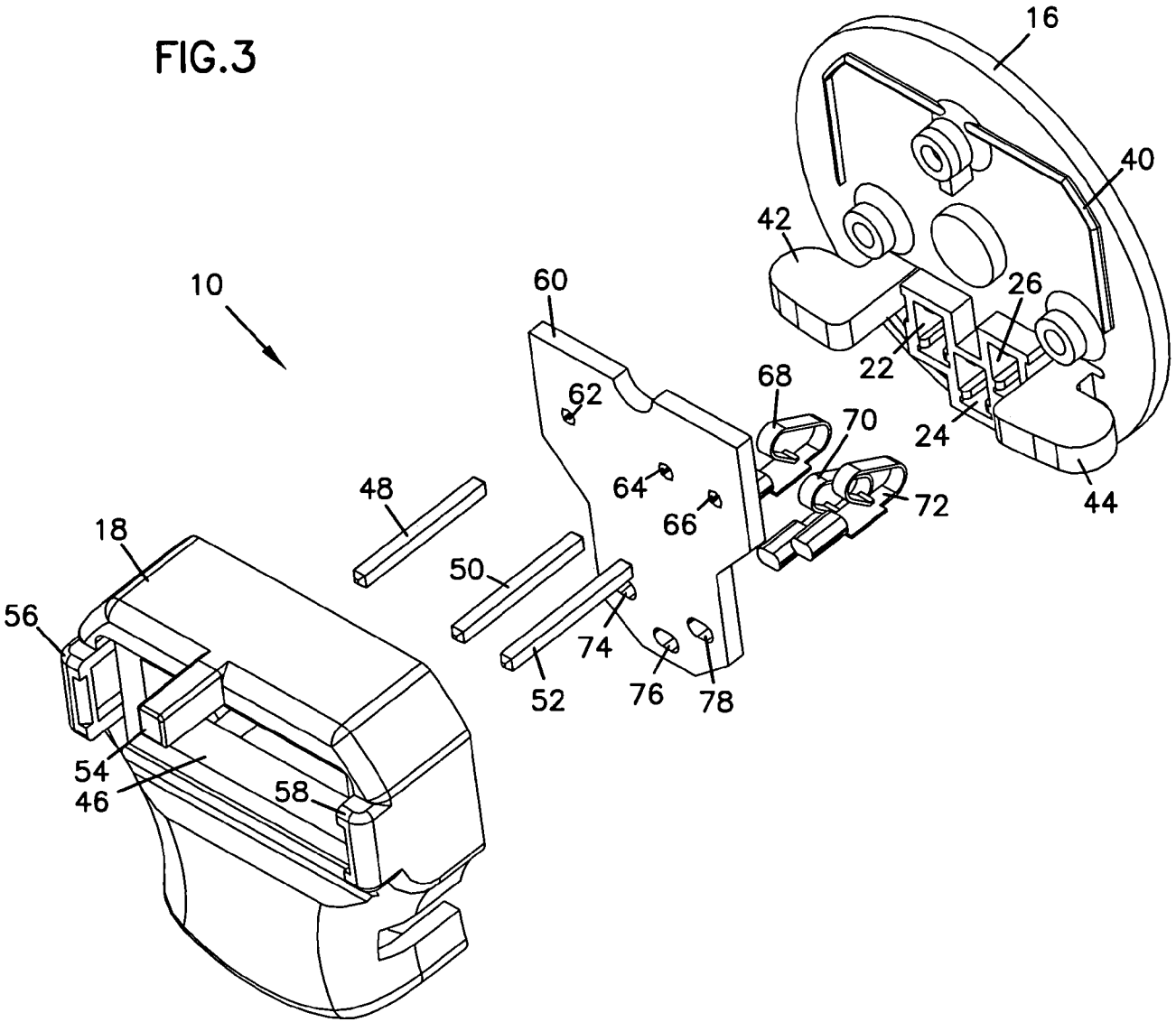
FIG. 3 is an exploded perspective view of the adaptor shown in FIG. 2.
Figure 5:
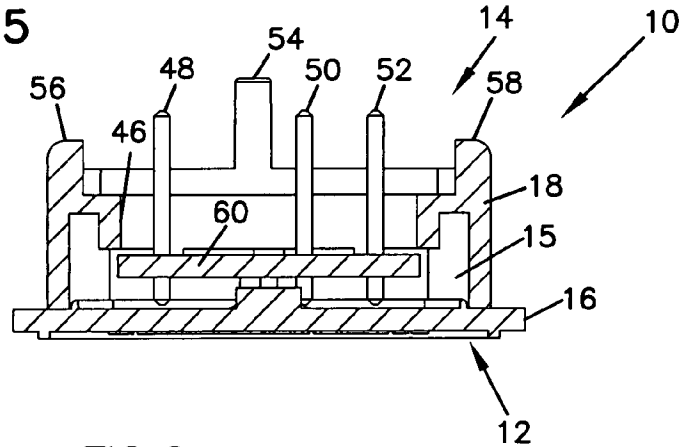
FIG. 5 is a cross-sectional view of the adapter shown in FIG. 4 taken along cross-sectional indicators 5—5.
Figure 6:
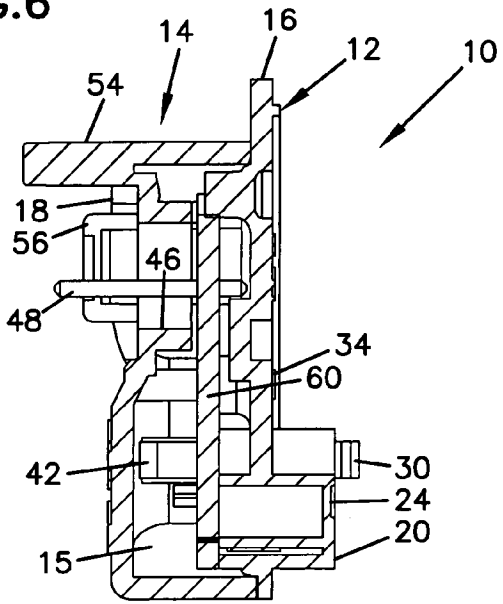
FIG. 6 is a cross-sectional view of the adapter shown in FIG. 4 taken along cross-sectional indicators 6—6.
Figure 4:
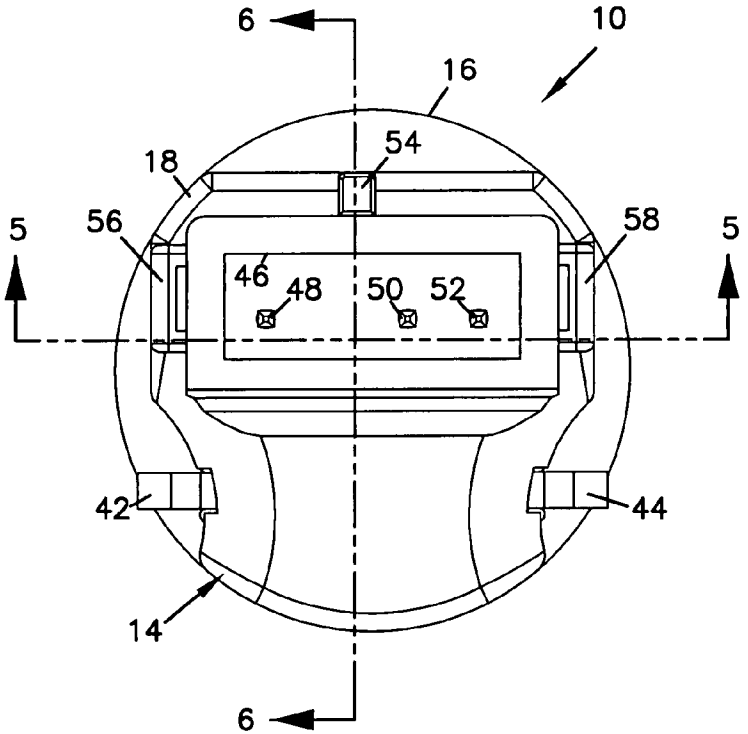
FIG. 4 is a plan view of the second side of the adapter shown in FIG. 2.
Figure 7:
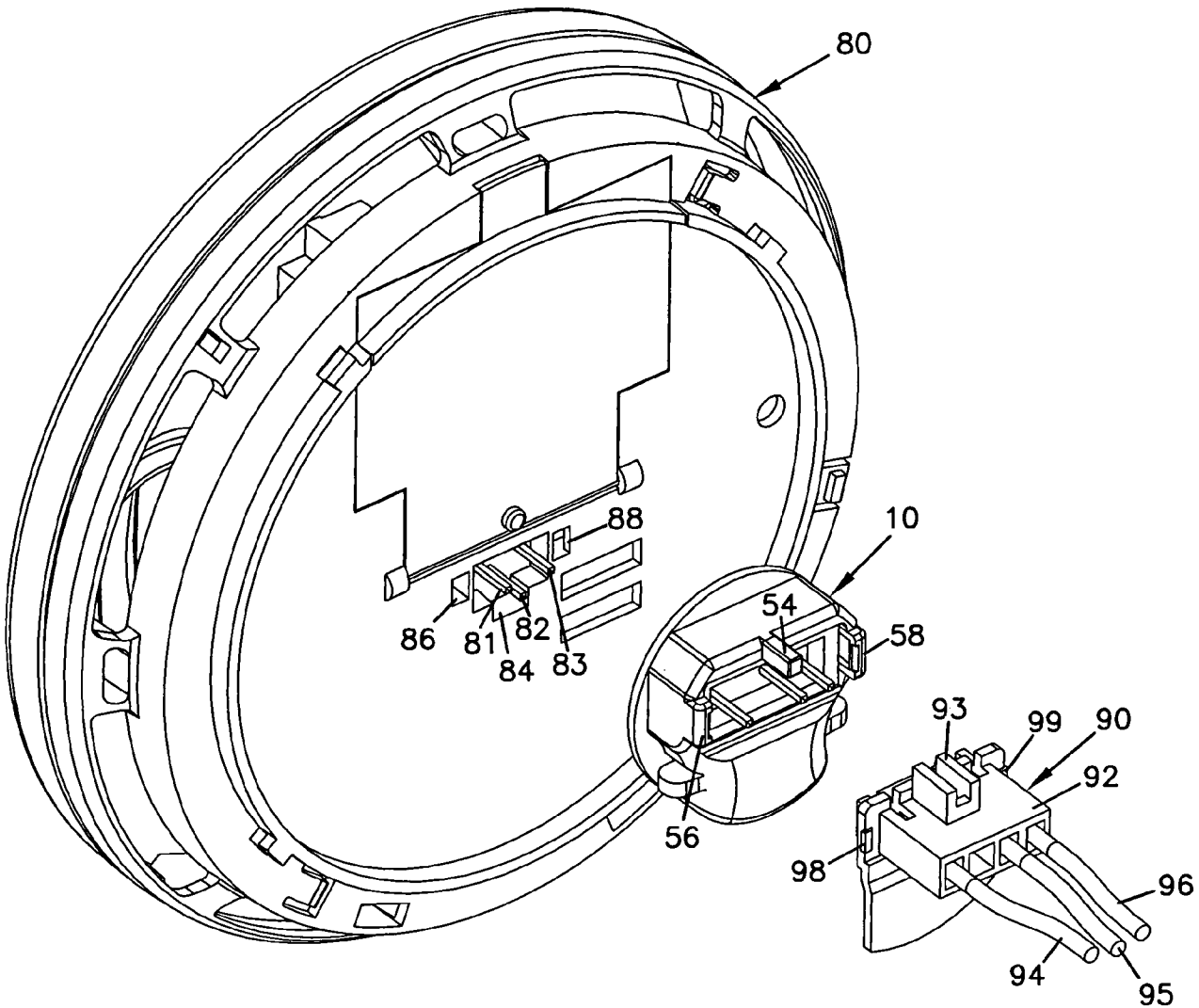
FIG. 7 is a perspective view of the adaptor shown in FIG. 2 positioned relative to an interconnect wire harness and a smoke alarm.
Figure 8:
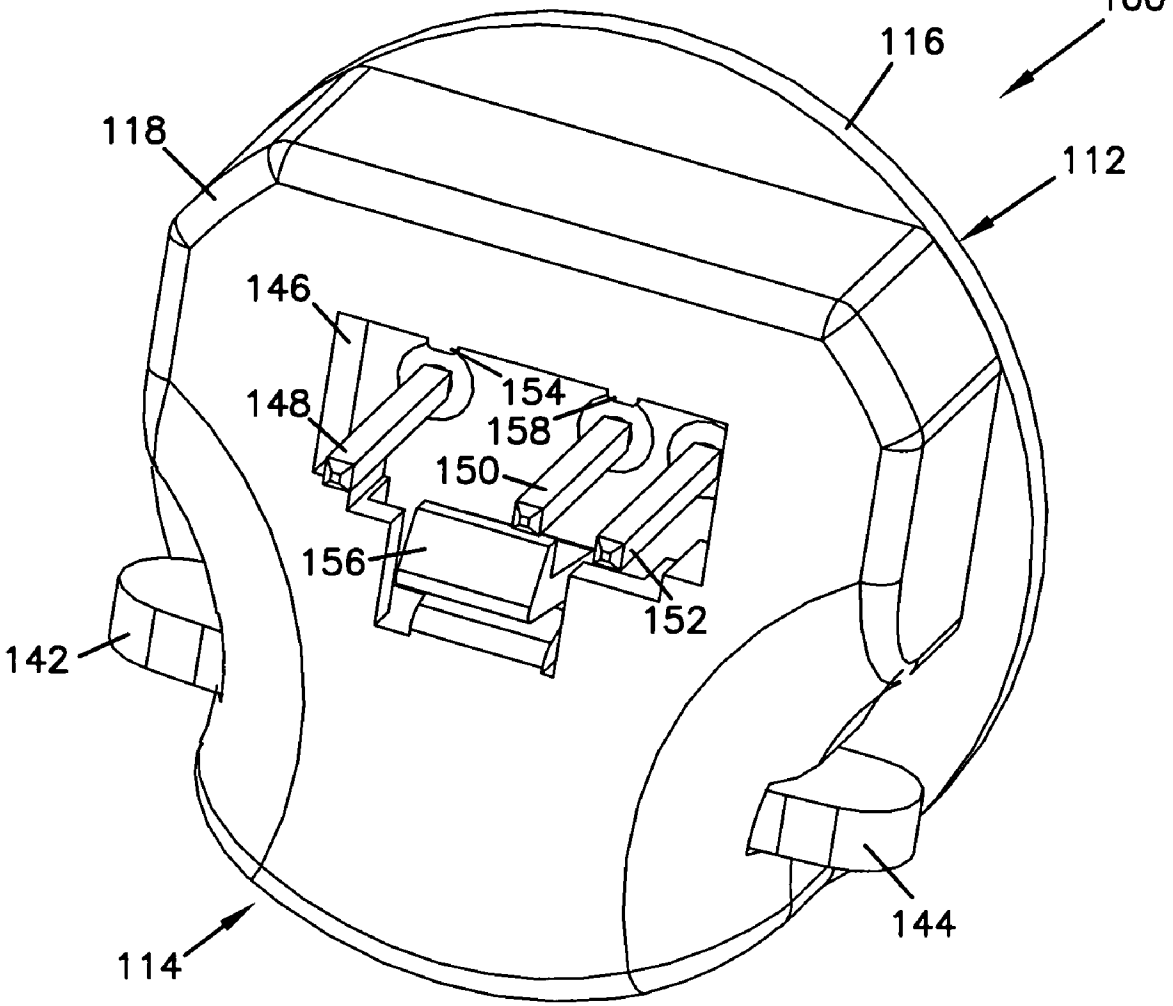
FIG. 8 is a perspective view of a second side of another example adaptor according to principles of the invention.
Figure 9:
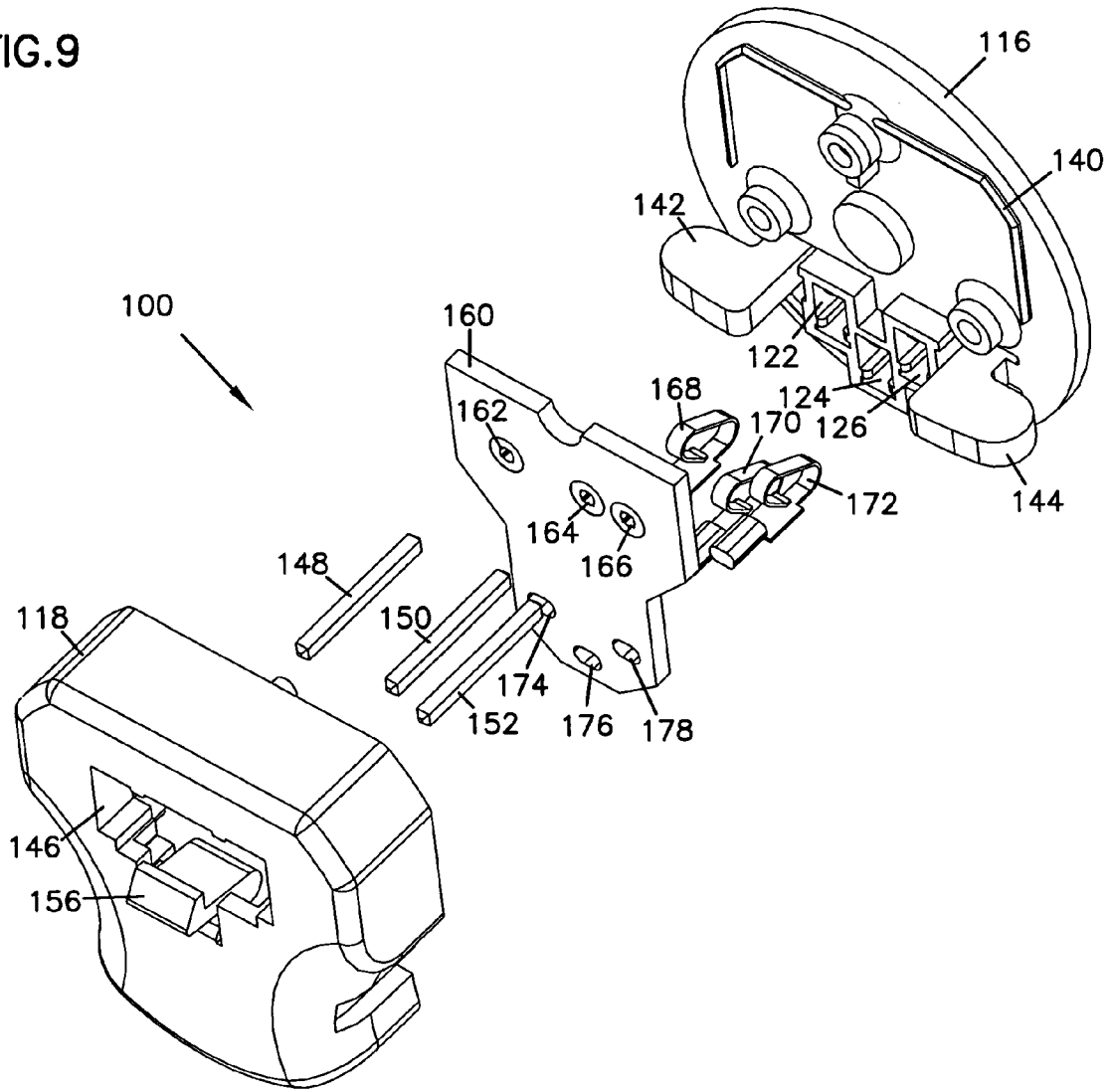
FIG. 9 is an exploded perspective view of the adaptor shown in FIG. 8.

An example adapter assembly 10 is shown and described with reference to FIGS. 1–7 and includes an alarm device connection side 12 and a harness connection side 14. The features of the alarm device connection side 12 may be the same or similar among the varying embodiments described herein with reference to the various drawings. Side 12 includes a first housing member 16 that includes an alarm device connector 20, first, second, and third female pin receivers 22, 24, 26, first and second device connectors 28, 30, and first, second and third connector protrusions 34, 36, 38 (see FIG. 1). Some features of alarm device connector side 12 are configured for coupling the adapter 10 to an alarm device 80 as shown in FIG. 7 (see further description of an alarm device below), while other features such as connector protrusions 34, 36, 38 may be used to couple the sides 12, 14 together.

The first housing member 16 also includes an alignment rib 40 that assists in properly positioning the sides 12, 14 relative to each other. A pair of connector tabs 42, 44 are coupled to the first and second device connectors 28, 30 for moving the connectors into a connecting or disconnecting position when mounting adapter 10 to alarm device 80 (see FIG. 3).

The harness connector side 14 (see FIG. 2) includes a second housing member 18 having a harness receding aperture 46, first, second and third male connector pins 48, 50, 52 and alignment protrusion 54, and first and second harness connectors 56, 58. The features of the harness connector side 14 are configured for attachment to a specific wire harness having a specific wire harness connector configuration, such as the configuration of harness 90 shown in FIG. 7 and described in further detail below.

The first and second housing member 16, 18, of the alarm device connector side 12 and the harness connector side 14, respectively, define a cavity 15 in which a circuit board 60 is enclosed. The circuit board 60 includes first, second and third connector pin apertures 62, 64, 66 that are configured to retain respective first, second and third male conductor pins 48, 50, 52. The circuit board 60 also includes first, second and third conductive contact apertures 74, 76, 78 configured to retain first, second and third conductive contacts 68, 70, 72 (see FIG. 3). Thus, the circuit board 60 provides a physical and electrical connection between the conductive contacts 68, 70, 72 and the male connector pins 48, 50, 52 within the cavity 15 defined between the first and second housing members 16, 18. The structure provided on the alarm device connection side 12 and the harness connection side 14 are adapted for converting from one connector configuration (for example, the connector design of a harness 90) to another connector configuration (for example, the alarm device connection configuration shown in FIG. 7).

The alarm device 80 includes first, second and third male connector pins 81, 82, 83, a connector receiving aperture 84, and first and second device connector apertures 86, 88. The male connector pins 81, 82, 83 are sized to be received in the female pin receivers 22, 24, 26, the connector receiving aperture 84 is sized to receive the alarm device connector 20, and the device connector apertures 86, 88 are sized to receive the device connectors 28, 30 in an interference, snap-fit connection.

The harness 90 shown in FIG. 7 includes a housing 92, a plurality of wires 94, 95, 96 that are coupled to individual female pin receivers (not shown), and first and second latch members 98, 99. A portion of the housing 92 is sized to be received in the harness receiving aperture 46 on the harness connection side 14 to help retain the male connector pins 48, 50, 52 within the female pin receivers (not shown) of the harness 90. The latch members 98, 99 are sized to be received in the harness connectors 56, 58 to provide a releasable connection between the adapter 10 and the harness 90. The harness 90 may also include an alignment recess 93 that engages the alignment protrusion 54 to help align the adapter 10 relative to the harness 90 to ensure proper insertion of the pins 48, 50, 52 in the female pin receivers.

Although FIGS. 1–7 illustrate a specific arrangement of connector configurations for the adapter 10, alarm device 80, and harness 90, these connector configurations can be intermixed or interchanged between the devices 10, 80, 90. For example, the features of the alarm device connector side 12 of the adapter 10 could be exchanged with the connector features of harness 90, and the features of the harness connector side 14 could be exchanged with the connector features of the alarm device 80. In this way, the adapter could be configured for adapting between many different alarm devices and harness connector configurations; whereas FIGS. 1–7 provide only one such example.

Another example adapter assembly 100 is shown with reference to FIGS. 8–13. Adapter 100 includes an alarm device connector side 112 and a harness connector side 114. The alarm device connector side 112 is substantially the same as alarm device connector side 12 (see FIGS. 1–7).

Figure 11:
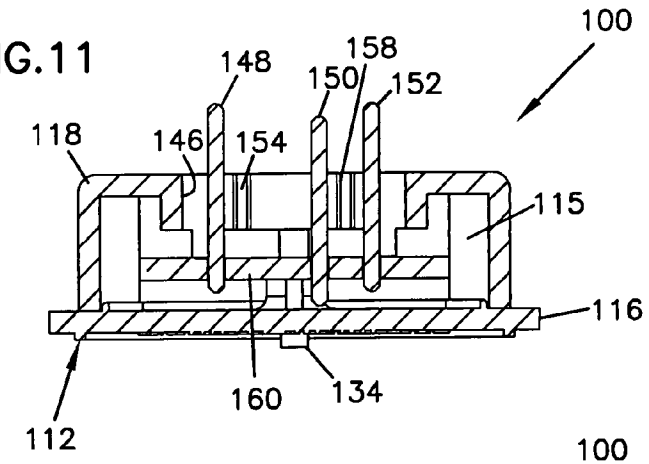
FIG. 11 is a cross-sectional view of the adapter shown in FIG. 8 taken along cross-sectional indicators 11—11.
Figure 12:
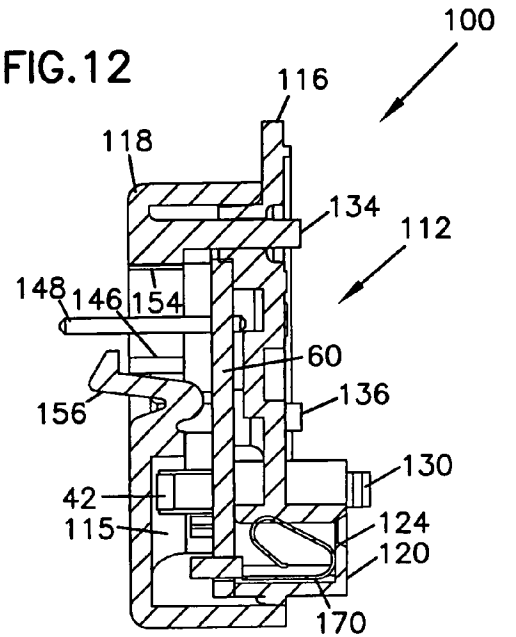
FIG. 12 is a cross-sectional view of the adapter shown in FIG. 8 taken along cross-sectional indicators 12—12.
Figure 10:
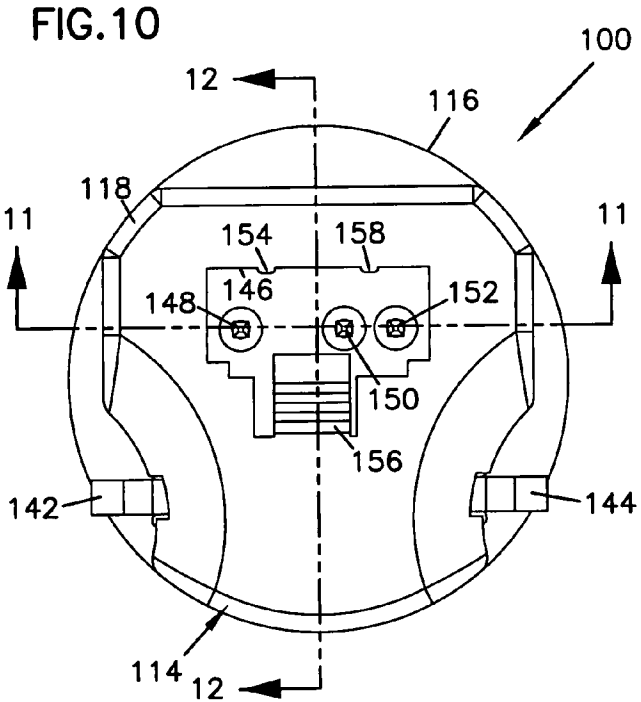
FIG. 10 is a plan view of the second side of the adapter shown in FIG. 8.
Figure 13:
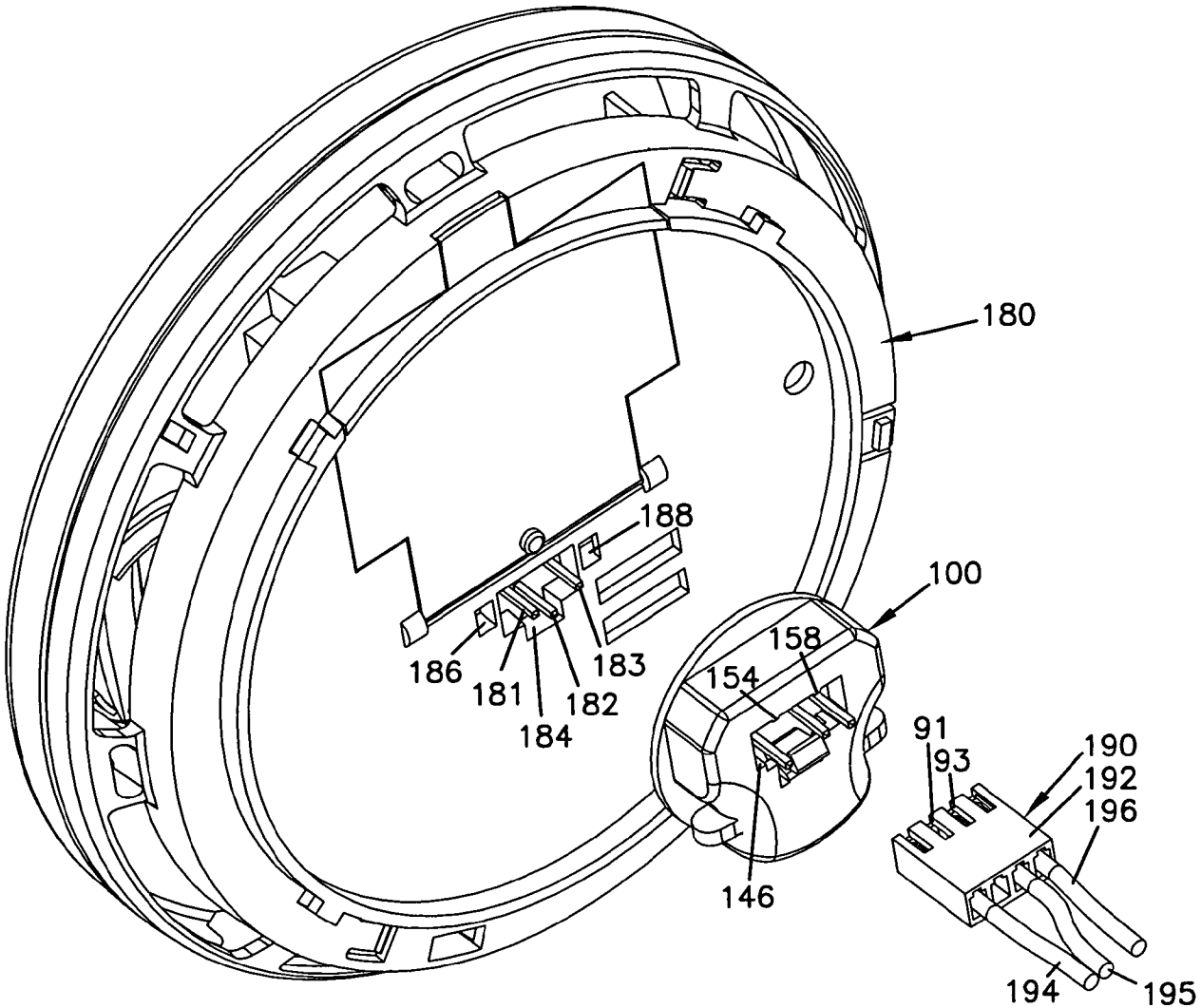
FIG. 13 is a perspective view of the adaptor shown in FIG. 8 positioned relative to a interconnect wire harness and smoke alarm.
Figure 14:
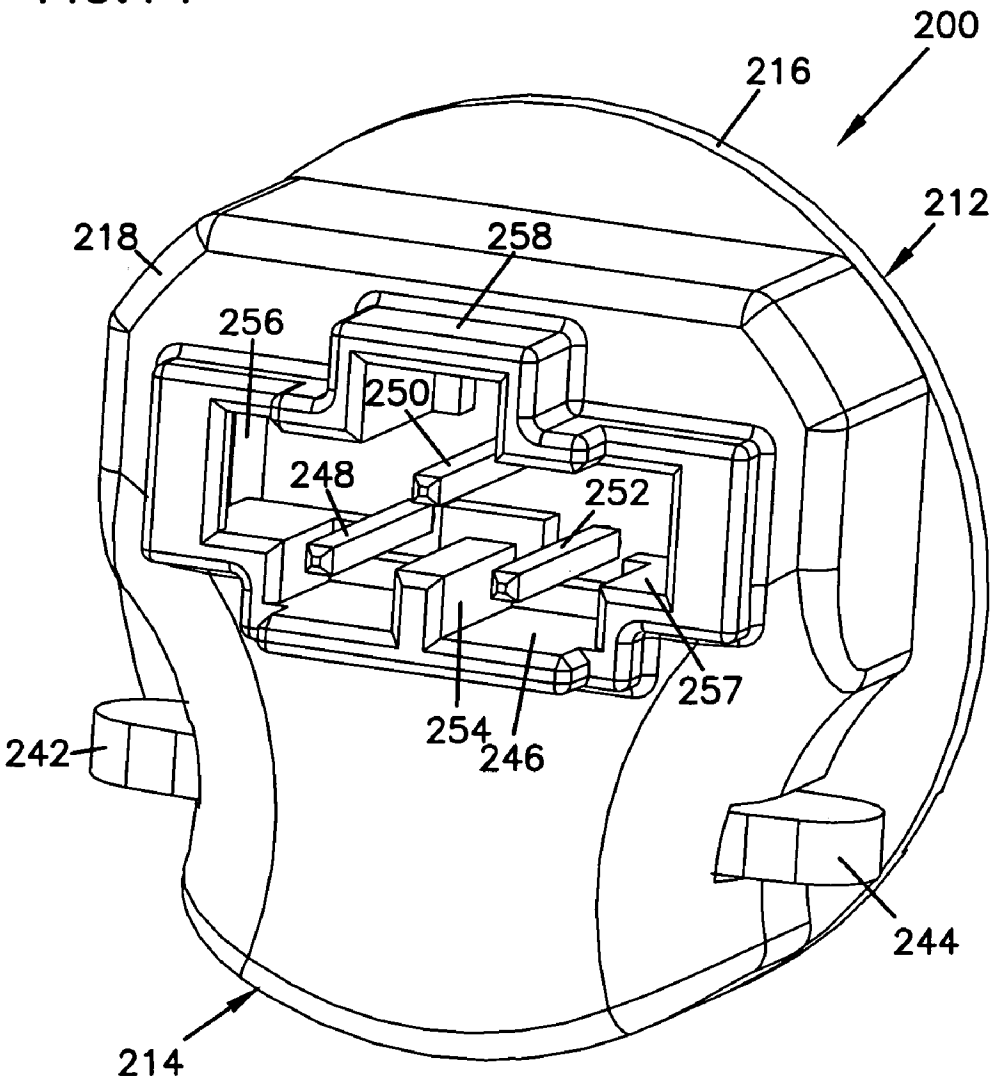
FIG. 14 is a perspective view of a second side of another example adaptor according to principles of the invention.
Figure 15:
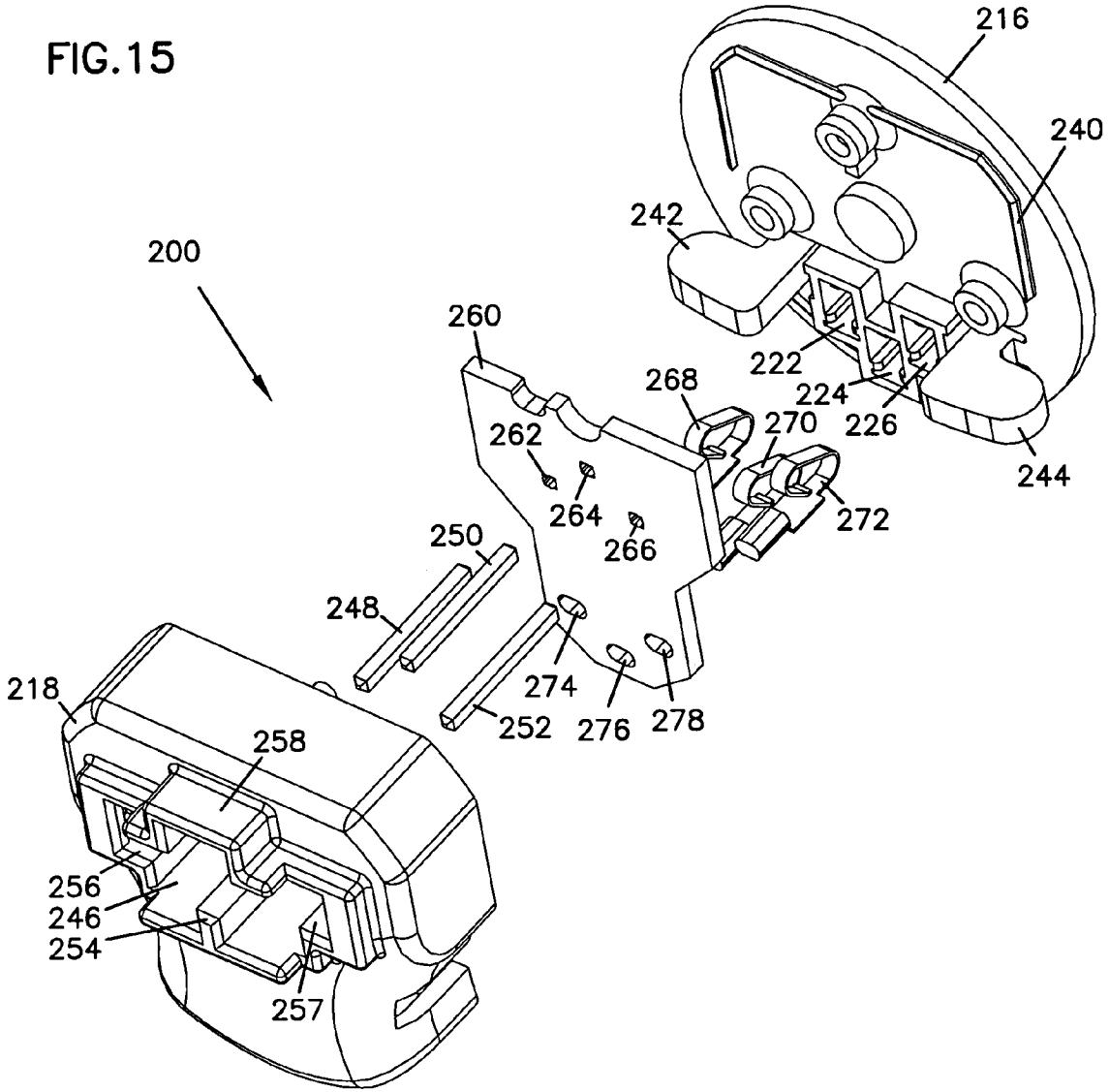
FIG. 15 is an exploded perspective view of the adaptor shown in FIG. 14.
Figure 17:
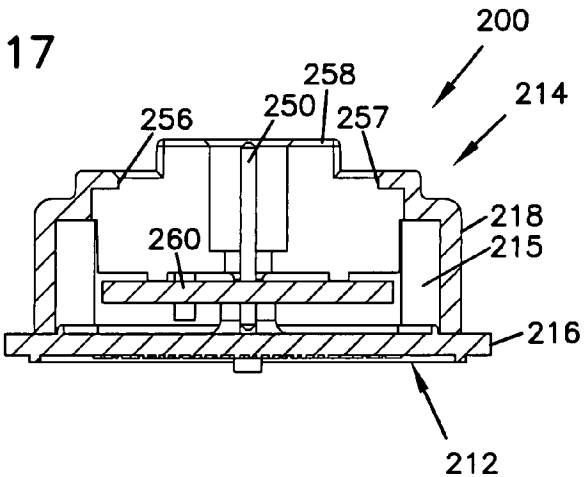
FIG. 17 is a cross-sectional view of the adapter shown in FIG. 14 taken along cross-sectional indicators 17—17.
Figure 18:
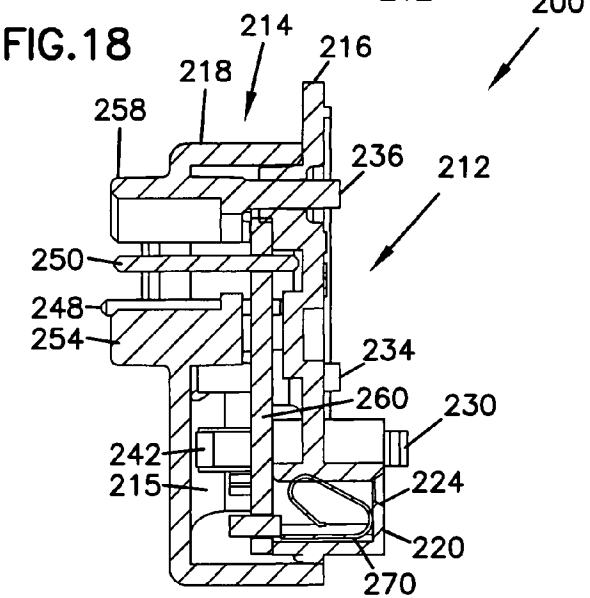
FIG. 18 is a cross-sectional view of the adapter shown in FIG. 8 taken along cross-sectional indicators 18—18.
Figure 16:
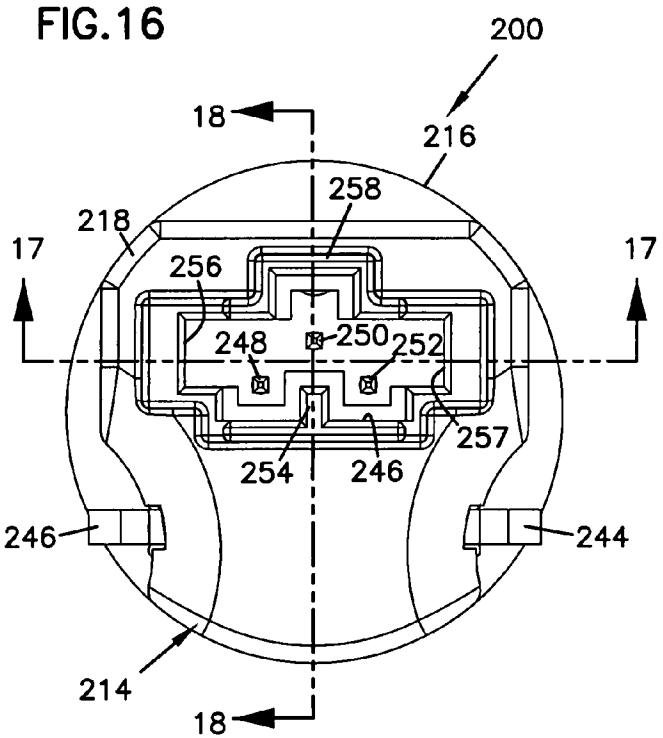
FIG. 16 is a plan view of the second side of the adapter shown in FIG. 14.

The alarm device connector side 112 includes a first housing member 116 that includes an alarm device connector 120, first, second and third female pin receivers (only pin receiver 124 is shown; see FIG. 12), first and second device connectors (only device connector 130 is shown; see FIG. 12), and first and second housing protrusions 134, 136 (a third connector protrusion is also preferably included in adapter 100, but is not shown in FIGS. 11 and 12). Some features of alarm device connector side 112 are configured for coupling the adapter 100 to an alarm device 180 as shown in FIG. 13, while other features such as connector protrusions 134, 136 may be used to couple the sides 112, 114 together.

The first housing member 116 also includes an alignment rib 140 that assists in properly positioning the sides 112, 114 relative to each other. A pair of connector tabs 142, 144 (see FIG. 9) are coupled to the first and second device connectors 128, 130 for moving the connectors into a connecting or disconnecting position when mounting adapter 100 to alarm device 180.

The harness connector side 114 includes a second housing member 118 having a harness receiving aperture 146, first, second and third male connector pins 148, 150, 152, first and second alignment protrusions 154, 158, and a harness connector 156. The male connector pins 148, 150, 152 may be used to establish an electrical connection between the adapter assembly 100 and wires coupled to a harness 190 (see FIG. 13). The harness connector 156 may include a pliable arm or other type of retaining clip that is deformable or otherwise adjustable to releaseably couple the harness 190 to the adapter assembly 100.

The first and second housing members 116, 118 together define a cavity 115 sized to substantially enclose a circuit board 160 and other features of adapter 100, as shown in FIGS. 11 and 12. The circuit board 160 include first, second and third connector pin apertures 162, 164, 166, and first, second and third conductive contact apertures 174, 176, 178 that are sized to receive first, second and third conductive contacts 168, 170, 172. Thus, the circuit board 160 provides a connecting structure between the conductive contacts 168, 170, 172 and the male connector pins 148, 150, 152, while supporting the male connector pins 148, 150, 152 and the conductive contacts 168, 170, 172 when the adapter assembly 100 is connected to the harness 190 and the alarm device 180.

Referring now to FIG. 13, the alarm device 180 includes first, second and third male connector pins 181, 182, 183 positioned within a connector receiving aperture 184. The alarm device 180 also includes first and second device connector apertures 186, 188 sized to receive first and second device connectors (for example, device connector 130) to releaseably couple the adapter assembly 100 to the alarm device 180. The male connector pins 181, 182, 183 are sized to be received within female pin receivers 122, 124, 126 and contact the conductive contacts 168, 170, 172. The connector receiving aperture 184 is sized to receive the alarm device connector 120.

The harness 190 includes a harness housing 192, a plurality of wires 194, 195, 196 that are in electrical communication with individual female pin receivers (not shown), and first and second alignment recesses 191, 193. The harness housing 192 sized to be received within the harness receiving aperture 146 with the male connector pins 148, 150, 152 being inserted within the female pin receivers (not shown). The harness 190 may also include an attachment protrusion or recess that is configured to be engaged and retained by the harness connector 156 thereby releaseably securing the harness 190 to the adapter.

As with the various connector configurations illustrated in FIGS. 1–7, the connector configurations shown in FIGS. 8–13 may be interchangeable. For example, the alarm device connector side 112 of the adapter assembly 100 may be exchanged with the harness 190 connection configuration, and the harness connector side 114 of the adapter assembly 100 may be exchanged with the connection features of the alarm device 180. In this way, the adapter assembly 100 may be used to adapt between different alarm device connector configurations and harness connector configurations.

Figure 19:
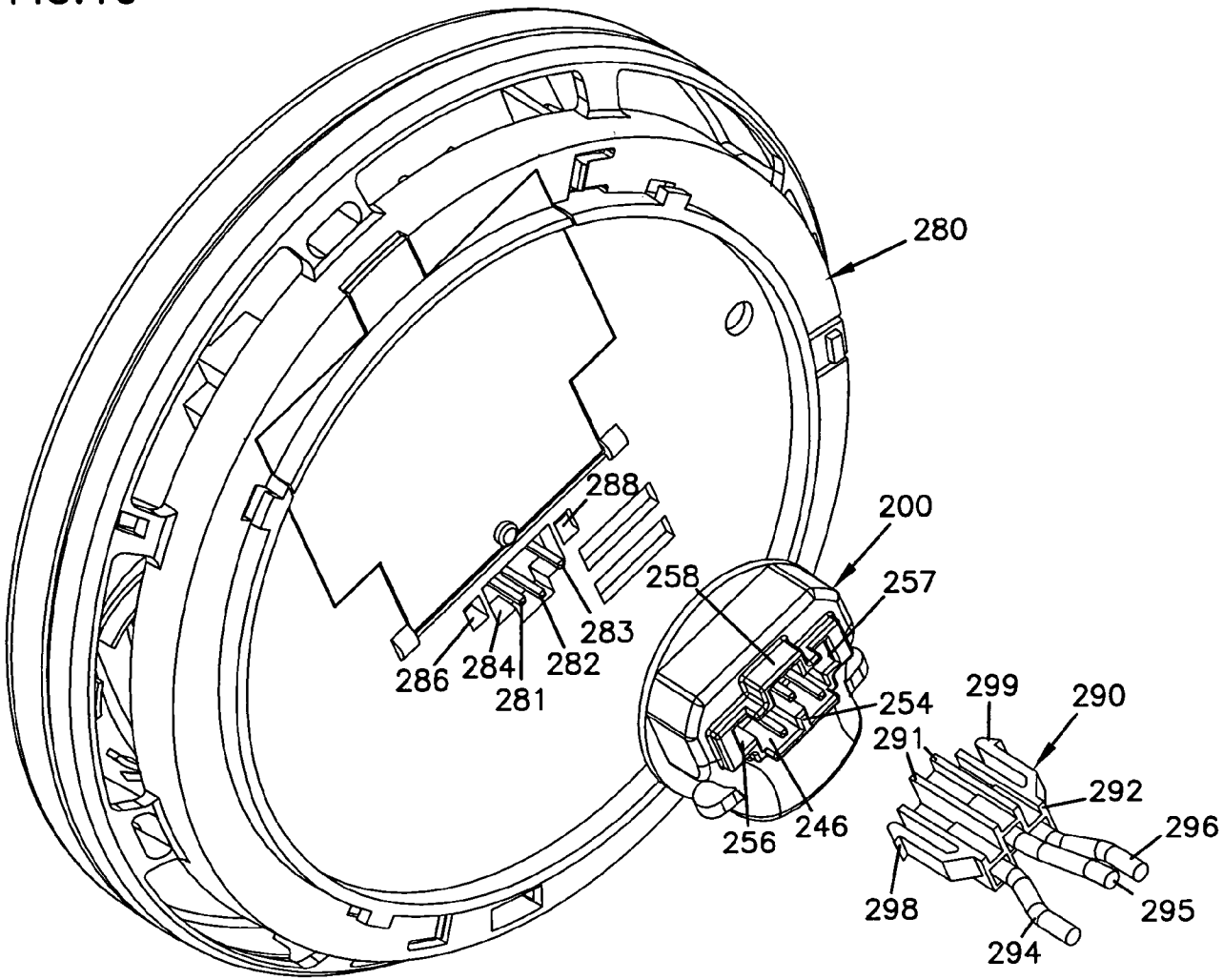
FIG. 19 is a perspective view of the adaptor shown in FIG. 14 positioned relative to a interconnect wire harness and smoke alarm.

Referring now to FIGS. 14–19, another adapter assembly 200 is shown and described. Adapter assembly 200 includes an alarm device connection side 212 that is configured for coupling to an alarm device (for example, see alarm device 280 shown in FIG. 19), and a harness connection side 214 that is configured for coupling to a wire harness (for example, see wire harness 290 shown in FIG. 19). The alarm device connection side 212 includes a first housing member 216 that includes an alarm device connector 220, first, second and third female pin receivers 222, 224, 226, first and second device connectors (only one device connector 230 is shown; see FIG. 18), and first and second connector protrusions 234, 236 (a third connector protrusion is preferably used in adapter 200, but is not shown in FIGS. 17 and 18). Some features of alarm device connector side 212 are configured for coupling the adapter 200 to an alarm device 280 as shown in FIG. 19, while other features such as connector protrusions 234, 236 may be used to couple the sides 212, 214 together.

The first housing member 216 also includes an alignment rib 240 that assists in properly positioning the sides 212, 214 relative to each other. A pair of connector tabs 242, 244 (see FIG. 15) are coupled to the first and second device connectors 228, 230 for moving the connectors into a connecting or disconnecting position when mounting adapter 200 to alarm device 280.

The harness connector side 214 includes the second housing member 218, a harness receiving aperture 246, first, second and third male connector pins 248, 250, 252, first and second alignment protrusions 254, 258, and first and second connector apertures 256, 257. The harness receiving aperture 246 is sized to receive a housing of the harness 290, the male connector pins 248, 250, 252 are configured for being electrically connected to wires associated with the harness 290, the alignment protrusions 254, 258 are sized to align the adapter assembly 200 with the harness 290, and the connector apertures 256, 257 are sized to receive connector members of the harness 290 (features of the harness 290 are described further below).

The first and second housing members 216, 218 of the adapter assembly 200 together define a cavity 215 that is sized to enclose a circuit board 260. The circuit board 260 includes first, second and third connector pin apertures 262, 264, 266 that are sized to receive the male connector pins 248, 250, 252, and first, second and third conductive contact apertures 274, 276, 278 that are sized to retain first, second, and third conductive contacts 268, 270, 272 (see FIG. 15). The circuit board 260 provides a structural connection and support base between the male connector pins 248, 250, 252 and the conductive contacts 268, 270, 272, while supporting those members during attachment and detachment of the adapter assembly 200 from the alarm device 280 and harness 290.

The alarm device 280 includes first, second, and third male connector pins 281, 282, 283 that are configured for insertion in the female pin receivers 222, 224, 226 of the adapter assembly 200, a connector receiving aperture 284 that is sized to receive the alarm device connector 220, and first and second device connector apertures 286, 288 sized to receive the device connectors (for example, device connector 230) to provide a positive attachment between the adapter assembly 200 and the alarm device 280.

The harness 290 includes a housing 292, a plurality of wires 294, 295, 296, and alignment protrusion 291, and first and second latch members 298, 299. The housing 292 is sized to be received within the harness receiving aperture 246 wherein the male connector pins 248, 250, 252 are inserted into individual female pin receivers (not shown) formed in the housing 292 that are in electrical connection with the wires 294, 295, 296. The alignment protrusion 291 provides alignment and engagement with the alignment protrusion 258. Housing 292 may include a separate alignment feature (not shown) that engages the first alignment protrusion 254 to further properly align the housing 292 in the harness receiving aperture 246 during connection of the harness 290 with the adapter assembly 200. The latch members 298, 299 are received within and engage the connector apertures 256, 257 in a releaseable connection (for example, a snap fit or interference fit connection) so as to provide positive attachment between the adapter assembly 200 and the harness 290.

As with the connector configurations shown with reference to FIGS. 1–13 above, the connector configurations of the adapter assembly 200, alarm device 280, and harness 290 may be interchanged in other embodiments. For example, the connection configuration of the alarm device connection side 212 of the adapter assembly 200 may be exchanged with the harness 290 connector features, and the connection configuration of the harness connection side 214 may be exchanged with the connector features of the alarm device 280. The interchangeability of the connector configurations provides for additional embodiment wherein the adapter assembly 200 can be used to adapt different connection features of a harness and alarm device.

Other embodiments of the present invention include an adapter that is configured to connect to a first connector configuration on one side (for example, an alarm device or a harness), and is configured to connect to multiple connector configurations on two or more separate sides of the adapter (for example, connector configurations for multiple harnesses that have the same or different connector features). For example, one example adapter assembly may include multiple sides that are each configured with a different connector configuration such that one or more sides of the adapter may be electrically connected to a wire harness of an innerconnect wire network, and the remaining sides of the adapter may be electrically connected to a separate alarm device having any one of several different connector configurations.

The adapter housing members shown with reference to FIGS. 1–19 include a two-piece housing that is preferably heat swedged together by heat deforming the connector protrusions (e.g., protrusions 34, 36, 38 of adapter 10), but may be coupled together in a different manner, such as, for example, being snap-fit together, fastened together with fasteners, or bonded together by adhesives. Other adapter housing embodiments may include more or fewer housing pieces, or may have features that are detachable from the adapter assembly such that the adapter can be modified into a variety of different connector configurations using the same basic adapter assembly features. Some embodiments may include housing members that are not coupled together as is shown in the Figures, wherein a housing member associated with each connector configuration is self-contained or at least independent from the other housing members. In such an embodiment, the male connector pins and the conductive contacts of the adapter may be coupled together with other connection means besides the PCB disclosed above such as, for example, wires, flex circuits, traces, pins, or the like.

The adapter housing pieces may include common moldable materials such as polymers or other non-conductive materials such as glass or ceramic materials that are cast, blown, or otherwise formed into the desired shape. The adapter housing may have a variety of different shapes besides the generally cylindrical shaped housing configuration shown in FIGS. 1–19. For example, the adapter housing may have a generally rectangular, hexagonal, or triangular shape and the adapter housing shape may provide a unique indication of, for example, the manufacturer, product line, power requirements, or model of the adapter assembly. The adapter housing may also incorporate additional features to ensure a reliable connection between the adapter and the alarm device or the harness using, for example, a snap fit, latch, fastener, or other connection means that fulfills the standard pull test requirements in the art.

The circuit board of the adapter assembly may include traces, wires, or other communications structure that extends between the connector pins and the conductive contact that are coupled to the circuit board. The communications structure may be traced, imbedded, or otherwise secured to the circuit board in any desired fashion. The circuit board may also include other electronic components and features such as transistors, receivers, transmitters, processors, or any other desired device that monitors or modifies the signal passing through the adapter assembly. In other embodiments, the adapter assembly may forgo the use of a circuit board by replacing the circuit board with separate mounting features for mounting the male connector pins and conductive contacts separately, and providing other means of connecting the male connector pins and conductive contacts together as desired.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A smoke alarm system, comprising:

an interconnect harness electrically connected to a wiring network;

a smoke alarm; and an adapter including a first connector configuration for coupling the adapter to the smoke alarm, and a second connector configurations for coupling the adapter to the interconnect harness, the first and second connector configurations being different from each other.

2. The system of claim 1, wherein the adapter includes a conductive contact, a male connector pin, a housing, and a mounting member positioned within the housing, the mounting member being configured to mount the conductive contact and the male connector pin.

3. The system of claim 1, wherein the first connection configuration includes an alignment member configured to align a harness connection feature with a connection feature of the first connection configuration.

4. The system of claim 1, wherein the first connection configuration includes a coupling member configured to engage the harness to couple the harness to the adapter.

5. The system of claim 1, wherein the second connection configuration includes a coupling member configured to engage the alarm device to couple the adapter to the alarm device.

6. The system of claim 1, wherein the adapter includes a housing member that includes a generally planar surface and the first connector configuration includes an alarm device connector mounted to the generally planar surface, the alarm device connector including at least one female receiver formed therein.

7. The system of claim 1, wherein the adapter includes a housing member that includes a generally planar surface and the second connector configuration includes an aperture defined in the generally planar surface and a male connector pin positioned within the aperture, the aperture being sized to receive a portion of the harness.

8. The system of claim 1, wherein the first connector configuration includes at least one female receiver configured to receive a male connector pin of the smoke alarm, and the second connector configuration includes at least one male connector pin configured to engage a female receiver of the interconnect harness.

9. The system of claim 8, wherein the first connector configuration includes three female receivers and second connector configuration includes three male connector pins.

10. The system of claim 9, wherein the first connector configuration further includes three conductive contacts associated with the three female receivers.

11. The system of claim 9, wherein the female receivers and male connectors pins are aligned with each other.

12. The system of claim 9, wherein the male connector pins are offset from each other in a non-linear arrangement.

13. The system of claim 9, wherein the female receivers are offset from each other in a non-linear arrangement.

14. A amoke alarm system, comprising:

a smoke alarm; and an adaptor including a first connector configuration for coupling the adapter to the smoke alarm, and a second connector configurations for coupling the adapter to a connector, the first and second connector configurations being different front each other.

15. The system of claim 14, wherein the connector is configured as an interconnect harness electrically connected to a wiring network.

16. The system of claim 14, wherein the adapter includes first and second opposing sides, the first side defining at least a portion of the first connector configuration and the second side defining at least a portion of the second connector configuration.

17. The system of claim 14, wherein the first connector configuration includes at least one female receiver configured to receive a male connector pin of the smoke alarm, and the second connector configuration includes at least one male connector pin configured to engage a female receiver of the interconnect harness.

18. The system of claim 14, wherein the adapter includes a conductive contact, a male connector pin, a housing, and a mounting member positioned within the housing, the mounting member being configured to mount the conductive contact and the male connector pin.

19. The system of claim 14, wherein the first connection configuration includes an alignment member configured to engage an alignment feature of the connector.

20. The system of claim 14, wherein the first connection configuration includes a coupling member configured to engage the connector to couple the connector to the adapter.

21. The system of claim 14, wherein the second connection configuration includes a coupling member configured to engage the alarm device to couple the adapter to the alarm device.

22. The system of claim 14, wherein the first connector configuration includes three female receivers and second connector configuration includes three male connector pins.

23. The system of claim 22, wherein the male connecter pins are offset from each other in a non-linear arrangement.

24. The system of claim 22, wherein the female receivers are offset from each other in a non-linear arrangement.

25. An alarm system, comprising;

an alarm device; and a first adapter including a first set of conductive pins configured to engage the alarm device, and a first set of conductive receivers configured to engage a first interconnect harness;

wherein a spacing of the conductive pins relative to each other is different from a spacing of the conductive receivers relative to each other.

26. The alarm system of claim 25, further comprising a second adapter having a second set of conductive pins configured to engage the alarm device, and a second set of conductive receivers configured to engage a second interconnect harness;

wherein a spacing of the first set of conductive pins relative to each other is the same as a spacing of the second set of conductive pins relative to each other, and a spacing of the first set of conductive receivers relative to each other is different from a spacing of the second set of conductive receiver relative to each other.

27. The alarm system of claim 25, wherein the adapter includes a housing, and the conductive pins protrude from one side of the housing and the conductive receivers include openings accessible from a second side of the housing.

28. The alarm system of claim 27, wherein the adapter includes a circuit board positioned at least partially within the housing, and the conductive pins and conductive receiver are coupled to each other via the circuit board.

* * * * *